US009188960B2

(12) United States Patent
Lagorgette et al.

(10) Patent No.: US 9,188,960 B2
(45) Date of Patent: Nov. 17, 2015

(54) MECHANISM FOR DRIVING THE HANDS OF AN ELECTROMECHANICAL WATCH, PROVIDED WITH A LOCKING DEVICE

(71) Applicant: ETA SA Manufacture Horlogere Suisse, Grenchen (CH)

(72) Inventors: Pascal Lagorgette, Bienne (CH); Joerg Berthoud, Villeret (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 53 days.

(21) Appl. No.: 14/082,357

(22) Filed: Nov. 18, 2013

(65) Prior Publication Data

US 2014/0146645 A1 May 29, 2014

(30) Foreign Application Priority Data

Nov. 23, 2012 (EP) ..... 12194079

(51) Int. Cl.
*G04C 3/14* (2006.01)
*G04C 3/12* (2006.01)

(52) U.S. Cl.
CPC ... *G04C 3/14* (2013.01); *G04C 3/12* (2013.01)

(58) Field of Classification Search
CPC ..... G04C 3/14; G04C 3/12
USPC ..... 368/37, 327
See application file for complete search history.

(56) References Cited

U.S. PATENT DOCUMENTS

| | | | | |
|---|---|---|---|---|
| 3,026,458 | A * | 3/1962 | Freystedt et al. | 318/132 |
| 3,504,206 | A * | 3/1970 | Fritsch | 310/21 |
| 3,604,201 | A * | 9/1971 | Dome | 368/135 |
| 4,162,417 | A * | 7/1979 | Grudzinski | 310/21 |
| 4,271,493 | A * | 6/1981 | Tamaru et al. | 368/28 |
| 2010/0097900 | A1 * | 4/2010 | Petremand et al. | 368/160 |
| 2013/0107677 | A1 * | 5/2013 | Willemin et al. | 368/200 |

FOREIGN PATENT DOCUMENTS

| | | |
|---|---|---|
| CH | 699 771 A2 | 4/2010 |
| FR | 2 389 930 | 12/1978 |
| FR | 2 616 238 A1 | 12/1988 |
| GB | 2 294 560 | 5/1996 |
| WO | WO 85/01130 | 3/1985 |

OTHER PUBLICATIONS

European Search Report issued Apr. 5, 2013 in European Application 12194079, filed on Nov. 23, 2012.

* cited by examiner

*Primary Examiner* — Sean Kayes
(74) *Attorney, Agent, or Firm* — Oblon, McClelland, Maier & Neustadt, L.L.P.

(57) ABSTRACT

A mechanism drives the hands of an electromechanical watch. It includes an electric motor, a set of gear wheels connected to the electric motor to move the hands forward or backward on each actuation of the electric motor, and a locking device. The locking device includes a piezoelectric actuator for locking, in a rest mode, directly or via a bolt, one wheel of the set between each actuation of the electric motor. The piezoelectric actuator releases the wheel of the set of gear wheels, when it is actuated by an electrical signal at the moment of each actuation of the electric motor to move the hands forward or backward.

13 Claims, 4 Drawing Sheets

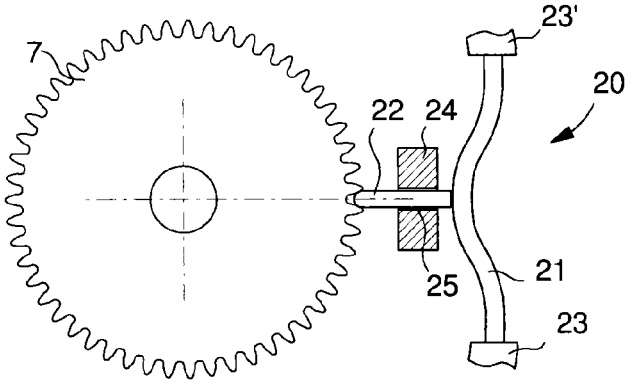
Fig. 2a
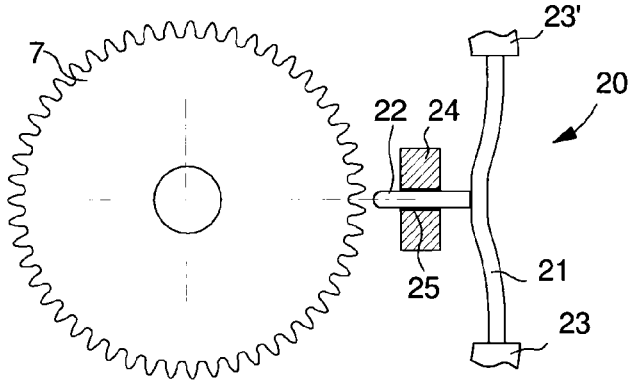
Fig. 2b
Fig. 3a
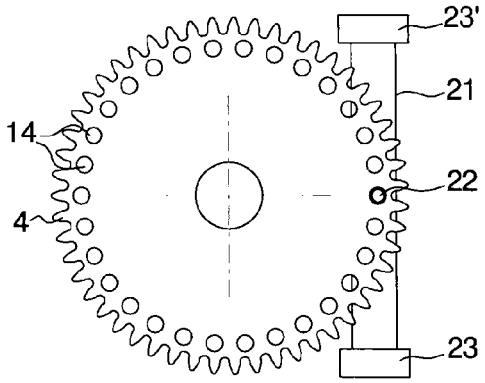
Fig. 3b
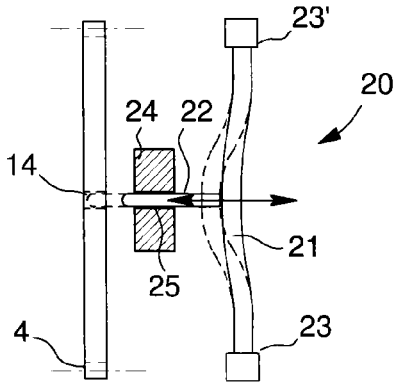

Fig. 4a
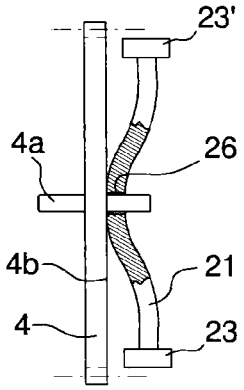
Fig. 4b
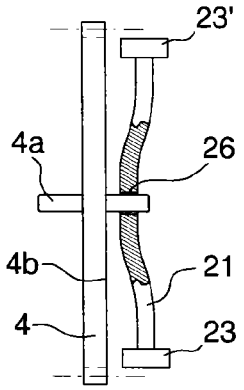
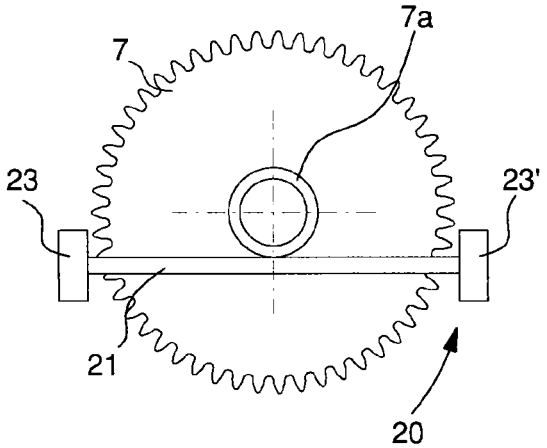
Fig. 5a
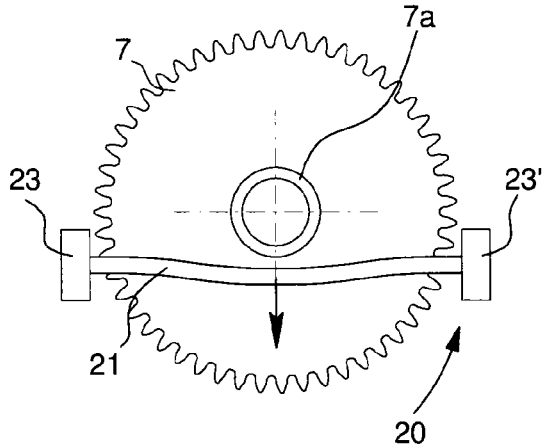
Fig. 5b

MECHANISM FOR DRIVING THE HANDS OF AN ELECTROMECHANICAL WATCH, PROVIDED WITH A LOCKING DEVICE

This application claims priority from European Patent Application No. 12194079.5 filed 23 Nov. 2012, the entire disclosure of which is incorporated herein by reference.

FIELD OF THE INVENTION

The present invention concerns a mechanism for driving one or more hands and/or at least one date disc of an electromechanical watch, which is provided with a locking or coupling device. The electromechanical watch has a time display via hands, which are driven by one or two or three wheels of a set of gear wheels of the drive mechanism. An electric motor drives the set of gear wheels to move the hands and/or at least one date disc forwards or backwards. The locking or coupling device is provided for momentarily locking one part of the set of gear wheels to prevent a time-lag, particularly of the hands, in the event of a shock to the watch, while allowing the hands to move forward freely to display or set the time.

BACKGROUND OF THE INVENTION

In an electromechanical watch, the hands are generally driven via a gear set or train, which may be actuated by a Lavet stepping motor. In that case, the hands are driven in steps by one or two wheels of the gear train by actuating the stepping motor. A significant positioning torque on the stepping motor means that time indicator hands with a high level of unbalance can be used. These hands may be larger or heavier. When there is a shock to the watch, the positioning torque of the electric motor can hold the hands in position, but there may be a time-lag in said time-indicator hands, which is a drawback of a state of the art electromechanical watch.

It is also to be noted that if the positioning torque becomes too high, the electric motor can no longer rotate, which is also a drawback. It is then necessary to optimise the electric motor as far as possible, but this inevitably also leads to an increase in the electrical power consumption required to drive hands with a high level of unbalance. This is undesirable when the watch is powered by a cell or battery.

CH Patent Application No. 699 771 A2, which discloses a locking device for a toothed wheel of a timepiece module, may be cited. The toothed wheel is driven by a click actuated by a Lavet stepping motor. Between each actuation of the motor, at least one guided finger is housed between two teeth of the toothed wheel to lock the wheel. The finger is driven into a locking position by an electrostatic actuator. However, the arrangement of locking the toothed wheel between each actuation of the electric motor is relatively complicated, which is a drawback.

SUMMARY OF THE INVENTION

It is therefore a main object of the invention to overcome the aforementioned drawbacks by proposing a mechanism for driving the hands and/or at least one date disc of an electromechanical watch which is provided with a locking device for increasing the unbalance and inertia of the hands driven by a motor with reduced electrical power consumption.

The present invention therefore concerns a mechanism for driving one or more hands and/or at least one date disc of an electromechanical watch, the mechanism including an electric motor, a set of gear wheels connected to the electric motor to move the hand or hands and/or the date disc forward or backward on each actuation of the electric motor, and a device for locking at least one wheel of the set of gear wheels, wherein the locking device includes a piezoelectric actuator or an electroactive polymer element or a shape memory element for locking via a bolt at least one of the wheels of the set of gear wheels between each actuation of the electric motor, while allowing the set of gear wheels connected to said electric motor to move the hands and/or the date disc forward or backward on each actuation of the electric motor, and wherein the bolt is guided in a through aperture of a stud fixed to a plate or a frame of the electromechanical watch.

The present invention further concerns a mechanism for driving one or more hands and/or at least one date disc of an electromechanical watch, the mechanism including an electric motor, a set of gear wheels connected to the electric motor to move the hand or hands and/or the date disc forward or backward on each actuation of the electric motor, and a device for locking at least one wheel of the set of gear wheels, wherein the locking device includes a piezoelectric actuator or an electroactive polymer element or a shape memory alloy element for directly locking at least one of the wheels of the set of gear wheels with one portion bearing on a surface of the wheel or against the wheel arbour, between each actuation of the electric motor, while allowing the set of gear wheels connected to said electric motor to move the hand or hands and/or the date disc forward or backward on each actuation of the electric motor.

Particular embodiments of the drive mechanism are defined in the dependent claims 3 to 13.

One advantage of the drive mechanism according to the invention lies in the fact that it permits the electric motor to have a relatively low positioning torque purely for defining the rotor rest position, but more for retaining the hand or hands with a high level of unbalance when there is a shock to the watch. The piezoelectric element or actuator locks one wheel of a set of gear wheels directly or in conjunction with a bolt. The set of gear wheels is driven by the electric motor, which may be a stepping motor, in order to move the time indicator hand or hands forwards or backwards. The bolt held by the piezoelectric actuator permits one wheel of the set of gear wheels to become integral with a frame or main plate of the watch between each drive action of the electric motor. By actuating the piezoelectric actuator via an electrical signal, the bolt can be moved to release said wheel and move one or several hands forwards or backwards using the electric motor. In place of the piezoelectric actuator, it is also possible to use an electroactive polymer element or a shape memory alloy element, which can be heated by a flow of current and thus deformed.

Another advantage of using a piezoelectric actuator to lock at least one wheel of a set of gear wheels between each action of the electric motor, is that it is possible to achieve an electric power consumption lower than or equal to that of a conventional mechanism. Improved performance, particularly in holding hands with a high level of unbalance in the event of mechanical shocks, may be noted with the locking generated by the piezoelectric actuator. The piezoelectric actuator can generate a significant locking force on at least one wheel of the set of gear wheels.

BRIEF DESCRIPTION OF THE DRAWINGS

The objects, advantages and features of the mechanism for driving the hands and/or at least one date disc of an electromechanical watch, which is provided with a locking device, will appear more clearly in the following non-limiting description made with reference to the drawings, in which:

FIGS. 2*a* and 2*b* show top views of at least one wheel of the mechanism with the locking device in a position for locking and a position for releasing the wheel of the first embodiment of the invention, FIGS. 3*a* and 3*b* show top and side views of at least one wheel of the mechanism with the locking device for locking and releasing the wheel of a second embodiment of the invention, FIGS. 4*a* and 4*b* show side views of at least one wheel of the mechanism with the locking device in a position for locking and a position for releasing the wheel of a third embodiment of the invention, FIGS. 5*a* and 5*b* show top views of at least one wheel of the mechanism with the locking device in a position for locking and a position for releasing the wheel of a fourth embodiment of the invention.

DETAILED DESCRIPTION OF THE INVENTION

In the following description, all those components of the mechanism for driving hands and/or at least one date disc, which are well known to those skilled in the art in this technical field, are described only in a simplified manner. The hand drive mechanism essentially includes a timepiece movement provided with an electric motor, which is controlled by a processor clocked by a time base circuit. The mechanism is provided with a locking or coupling device capable of locking at least one wheel of the mechanism between two forward or backward actuations of the hands, which are generated by the electric motor.

Figure 1:
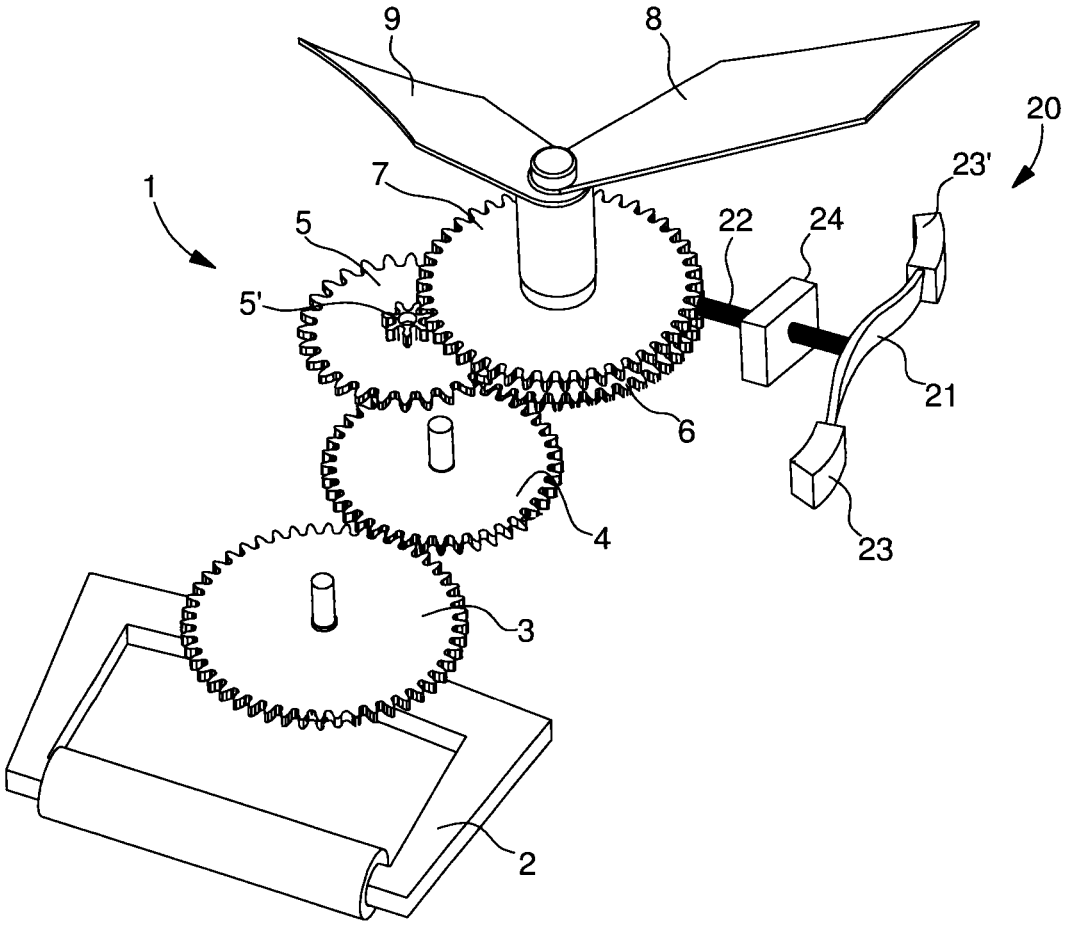
FIG. 1 shows a simplified three-dimensional view of the hand drive mechanism of an electromechanical watch, which is provided with a locking device in accordance with a first embodiment of the invention.

FIG. 1 is a schematic view of the various elements which form mechanism 1 for driving one or more hands 8, 9 and/or at least one date disc (not shown), of an electromechanical watch. The various elements described below are illustrated without necessarily observing their actual dimensions for the purpose of simplicity and clarity of the description.

Mechanism 1 first of all includes an electric motor 2 and a set of gear wheels 3, 4, 5, 6 and 7, which are arranged between the electric motor and at least one of hands 8, 9, in particular for moving time-indicator hand or hands 8, 9 forwards or backwards. Mechanism 1 also includes, according to the invention, a locking or coupling device 20 as explained below with reference to the various embodiments shown, whose function is to lock at least one wheel of the set of gear wheels, in particular between each action of electric motor 2 to move the time-indicator hands forwards or backwards.

Electric motor 2 is fixed in a conventional manner onto a watch plate (not shown), and one end of the arbours of wheels 3, 4, 5 and 6 of the set of gear wheels is mounted onto the watch plate free to rotate. The other end of the arbours of wheels 3, 4, 5 and 6 is held rotating freely at least on a bridge fixed to the plate or through an aperture in a watch dial. This electric motor 2 is preferably a Lavet stepping motor. Electric motor 2 is essentially formed of a coil mounted on a magnetic circuit defining the stator, and a rotor (not shown) arranged coaxially on the arbour of a first wheel 3 of the set of gear wheels.

Although not shown in FIG. 1, the motor coil is connected to an electric drive circuit of the motor, which may form part of a processor circuit clocked by a conventional quartz resonator oscillator stage. The motor rotor is driven in rotation clockwise or anti-clockwise according to the electrical drive pulses delivered by the electrical drive circuit. Between each electrical actuation, the electric motor is in a rest mode and has to guarantee a determined positioning torque, so as to hold time indicator hands 8, 9 of the watch without any time-lag. If hands 8 and 9 are devised with a large unbalance, locking device 20 is provided, for locking at least one toothed wheel, for example toothed wheel 7, between each forward or backward actuation of electric stepping motor 2. If there is a shock to the watch, this permits time indicator hands 8, 9 to be held without any time-lag.

The set of gear wheels may include, as shown, a first toothed wheel 3, whose arbour is connected to the rotor of electric motor 2, for actuating a second toothed wheel 4 on each actuation of electric motor 2. The second toothed wheel 4 meshes with a third toothed wheel 6, which carries minute hand 8 on its arbour. A fourth toothed wheel 5 meshes with a complementary gear (not shown) on the arbour of third toothed wheel 6. This fourth toothed wheel 5 includes a second gear 5' on its arbour to be used as a reduction gear, in order to drive a fifth toothed wheel 7 arranged coaxially on the arbour of third toothed wheel 6. The axial tube of fifth toothed wheel 7 carries the hour hand 9.

Locking or coupling device 20 includes, in particular, a piezoelectric element or actuator 21, which is fixed at one end to a first support 23 of the electromechanical watch frame, which may be directly fixed to the watch plate, which carries the timepiece movement. The other end of piezoelectric actuator 21 may also be fixedly held or free to move in a second support 23' of the frame. Piezoelectric actuator 21 may be a strip of generally rectangular shape placed in a curved position so as to press in the rest position directly against toothed wheel 7 to hold said wheel locked between two actuations of electric motor 2. Preferably, a bolt 22, guided in an aperture of a guide stud 24 fixed to the watch plate, is pushed by piezoelectric actuator 21 in the rest position between two teeth of toothed wheel 7 to keep said wheel locked between two drive actuations of the electric motor.

Locking device 20, via piezoelectric actuator 21 and for example bolt 22, holds one of the toothed wheels of the set of gear wheels secured to the frame or plate. The locking of one of toothed wheels 7 is performed between two actuations of electric motor 2, i.e. between two drive steps for moving the time indicator hand or hands 8 and 9 forward or backward. However, on each actuation of the motor to move the hand or hands 8 and 9 forward or backward, coupling or locking device 20 is released. This means that piezoelectric actuator 21 is excited in its own ultrasonic mode or by a supply voltage to move in an opposite direction to the wheel locking direction. The supply voltage may originate from the processor circuit (not shown). This also allows bolt 22 to be moved in the opposite direction to the locking position, to release, in particular, toothed wheel 7 to allow hands 8 and 9 to move forwards or backwards.

Since the Lavet electric motor always has quite a low positioning torque, the torque defines a rest position of the rotor, but normally cannot retain the hand or hands in the event of a shock to the watch. Thus, due to the presence of piezoelectric actuator 21 and bolt 22, which is pushed radially by said actuator in a rest mode against one of the wheels of the set of gear wheels, the time indication of the hands is maintained between each actuation of the electric motor regardless of any shock experienced by the watch. In the event of a shock, the rotation torque is directly transmitted to bolt 22 and not directly to piezoelectric actuator 21. These shocks may have a value equal to 500 G or 5000 G, which means that it is not possible for electric motor 2 and its positioning torque alone to maintain the hands in the proper time indication position.

The time periods required to actuate the piezoelectric actuator are much shorter than the rest times, which results in reduced electrical power consumption. The electrical signals delivered to the motor coil may, in part, be used to actuate piezoelectric actuator 21, in order to release the toothed wheel 7 which is locked between two successive actuations of electric motor 2.

The piezoelectric actuator may be formed of titanium oxide or defined as a lead zirconate titanate (PZT). It may be formed by several layers of this type of piezoelectric material deposited in succession on top of each other, to form a thickness of between 0.1 to 1 mm, for example.

It should be noted that in place of piezoelectric actuator 21, it is also possible to envisage using an electroactive polymer element or shape memory alloy element. This shape memory alloy element can be heated by the flow of a current and thus deformed, causing it to move away from and release the wheel.

A first embodiment of the locking or coupling device is shown in FIGS. 2*a* and 2*b*. This first embodiment is that described above with reference to FIG. 1. Locking device 20 thus includes a piezoelectric element or actuator 21, which is fixed at a first end to a first support 23 of the electromechanical watch frame. A second end of piezoelectric actuator 21 may also be fixedly held or free to move in a second support 23' of the frame. The first and second supports 23, 23' may be directly secured by bonding or welding, or screwed onto the watch plate, which carries the timepiece movement.

Piezoelectric actuator 21 may be a strip of generally rectangular shape placed in a curved position at rest to push a bolt 22 radially between two teeth of one wheel of the set of gear wheels, as shown in FIG. 2*a*. The toothed wheel locked by bolt 22 may be, for example, toothed wheel 7, carrying the hour hand on the axial tube thereof, but it may also be another wheel of the set of gear wheels.

Bolt 22 is in the form of a cylindrical rod with a rounded end, which is housed between two teeth of toothed wheel 7 to lock said wheel. The diameter of this cylindrical rod is adapted to the mean gap between two teeth of said toothed wheel 7 to ensure that wheel 7 is locked properly. Cylindrical bolt 22 is guided in a through aperture 25 made in a stud 24 fixed to the watch plate or frame. This aperture 25 is cylindrical and has a slightly larger diameter than the diameter of bolt 22 to enable the bolt to slide freely in guide aperture 25. The other end of bolt 22 bears on a portion of piezoelectric actuator 21, which may be a central portion of said actuator. This other end of bolt 22 may be bonded or welded or screwed onto the central portion of the piezoelectric actuator. In FIG. 2*a*, bolt 22 is thus pushed between the two teeth of wheel 7 by piezoelectric actuator 21, for example in the rest position.

In FIG. 2*b*, piezoelectric actuator 21 may be actuated for example electrically by means of an electrical signal in the form of a supply voltage delivered to the two electrodes (not shown) of said actuator. When the electrical actuation is delivered to piezoelectric actuator 21, the actuator is moved in an opposite direction to the locking direction shown in FIG. 2*a*. Bolt 22 can also be pulled into a wheel 7 release position by piezoelectric actuator 21. However, since the end of bolt 22 has a rounded shape, the teeth of toothed wheel 7, which may be driven in rotation, can easily push back said bolt 22, when the piezoelectric actuator is electrically actuated.

It should also be noted that the shape of bolt 22 may also be different from a simple cylindrical rod. Said bolt 22 may be devised as a rod of rectangular or polygonal cross-section, to be able to slide in an aperture 25 in stud 24 of corresponding shape. Said bolt 22 may also have a curved shape as can the aperture 25 which receives it, provided that the bolt can easily occupy either a wheel 7 locking position, or a wheel release position which allows said wheel to rotate freely.

A second embodiment of the locking or uncoupling device is shown in FIGS. 3*a* and 3*b*. This second embodiment includes identical elements to those described with reference to FIGS. 1, 2*a* and 2*b*. Locking device 20 includes a piezoelectric element or actuator 21, which is fixed at a first end to a first support 23 of the electromechanical watch frame. A second end of piezoelectric actuator 21 may be fixedly held or free to move in a second support 23' of the frame. The first and second supports 23, 23' may be directly secured by bonding or welding, or screwed onto the watch plate, which carries the timepiece movement.

In this second embodiment, locking device 20 includes a bolt 22 capable of being pushed by piezoelectric actuator 21 into one hole 14 among several holes made in a toothed wheel of the set of gear wheels. The number of holes 14 may match the number of teeth of said wheel, and said holes are regularly spaced and arranged on a concentric circle to said wheel. Bolt 22 is preferably pushed axially by piezoelectric actuator 21, which is a strip of generally rectangular shape and curved in a rest mode. This toothed wheel may, by way of example, be the second toothed wheel 4, but another wheel may also be used.

Bolt 22 may be made in the form of a cylindrical rod with a rounded end, which is housed, via an axial movement, in a hole 14 of second wheel 4 to lock said wheel. The diameter of this cylindrical rod is adapted to be slightly smaller than the diameter of each hole 14 in second wheel 4. Cylindrical bolt 22 is guided in a through aperture 25 made in a stud 24 fixed to the watch plate or frame. This aperture 25 is cylindrical and has a slightly larger diameter than the diameter of bolt 22 to enable the bolt to slide freely in guide aperture 25. The other end of bolt 22 bears on a portion of piezoelectric actuator 21, which may be a central portion of said actuator. This other end of bolt 22 may be bonded or welded or screwed onto the central portion of the piezoelectric actuator.

In FIG. 3*b*, piezoelectric actuator 21 may be actuated for example electrically by means of an electrical signal in the form of a supply voltage delivered to the two electrodes (not shown) of said actuator. When the electrical actuation is delivered to piezoelectric actuator 21, the actuator is moved in an opposite direction to the locking direction. The movement of piezoelectric actuator 21, whether actuated or not actuated, and of bolt 22 is symbolized by the arrows in FIG. 3*b*. Piezoelectric actuator 21 and bolt 22 are shown in the preferred state in FIG. 3*b*, when the actuator is electrically actuated, while the position of the non-actuated actuator 21 and of bolt 22 is shown in dotted lines. Bolt 22 can also be pulled into a wheel 4 release position by piezoelectric actuator 21.

It should also be noted that in this second embodiment bolt 22 remains engaged in a hole 14 in toothed wheel 4 when said wheel is locked. In the event of a radial shock, bolt 22, in one of holes 14, locks wheel 4 with no effect on piezoelectric actuator 21.

A third embodiment of the locking or coupling device is shown in FIGS. 4*a* and 4*b*. Locking device 20 includes only piezoelectric actuator 21, which is fixed at a first end to a first support 23 of the electromechanical watch frame. A second end of piezoelectric actuator 21 may be fixedly held or free to move in a second support 23' of the frame. Piezoelectric actuator 21 alone is used to lock one wheel of the set of gear wheels or to release said wheel to allow it to rotate under the action of the electric motor.

Piezoelectric actuator 21 includes a through aperture 26 preferably arranged in a central portion leaving wide clearance for the passage of arbour 4*a* of toothed wheel 4 of the set of gear wheels. The two ends of wheel arbour 4*a* are mounted to move freely between a bridge and the watch plate (not shown in FIGS. 4*a* and 4*b*). The general shape of piezoelectric actuator 21 is similar to the general rectangular strip shape shown in FIGS. 1, 2*a*, 2*b*, 3*a* and 3*b*.

In FIG. 4*a*, piezoelectric actuator 21 is in a curved rest position to be pressed with some force onto a lower or upper surface 4*b* of toothed wheel 4. However, in FIG. 4*b*, piezoelectric actuator 21 is actuated, in particular by an electrical signal in the form of a supply voltage, to force it to move away from upper surface 4*b* of toothed wheel 4 and thus to release the lock. In this configuration, toothed wheel 4 can rotate freely on every actuation of the electric motor.

A fourth embodiment of the locking or coupling device is shown in FIGS. 5*a* and 5*b*. Locking device 20 also includes only piezoelectric actuator 21, which is fixed at a first end to a first support 23 of the electromechanical watch frame. A second end of piezoelectric actuator 21 may be fixedly held or free to move in a second support 23' of the frame. Piezoelectric actuator 21 is used alone to lock one wheel of the set of gear wheels or to release said wheel to allow it to rotate on each actuation of the electric motor.

In this fourth embodiment in FIG. 5*a*, piezoelectric actuator 21 is in the form of a rectangular strip, which is arranged to bear, for example in a rest position, against axial tube 7*a* of fifth toothed wheel 7. When bearing against the axial tube, the strip of piezoelectric actuator 21 can be arranged to not be curved while applying a locking force on said axial tube 7*a*. However, in FIG. 5*b*, piezoelectric actuator 21 is actuated by an electrical signal in the form of a supply voltage to force the actuator to move away from axial tube 7*a* of toothed wheel 7 and thus to release the lock. The movement away of piezoelectric actuator 21 is symbolised by the arrow defining a force due to the electrical actuation of the actuator. In this configuration, toothed wheel 7 can rotate freely on every actuation of the electric motor.

Figure 6A:
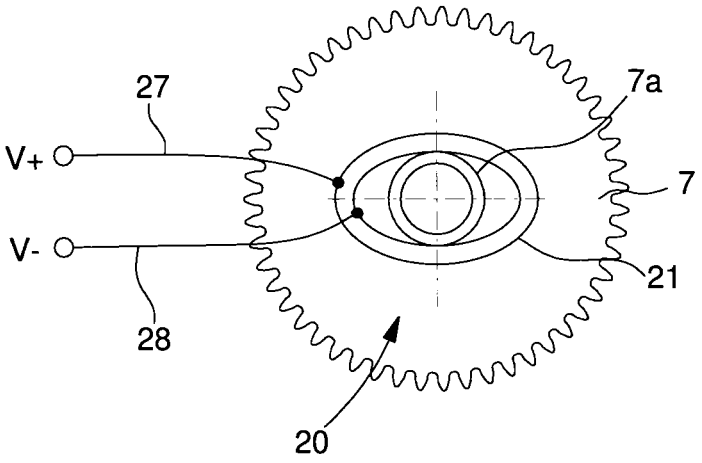
FIGS. 6*a* and 6*b* show top views of at least one wheel of the mechanism with the locking device in a position for locking and a position for releasing the wheel of a fifth embodiment of the invention.
Figure 6B:
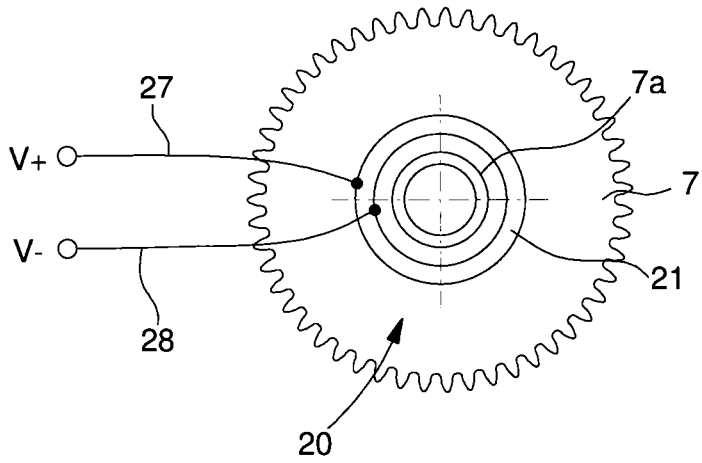

Finally, a fifth embodiment of the locking or coupling device is shown in FIGS. 6*a* and 6*b*. Locking device 20 also only comprises piezoelectric actuator 21, which is configured in the form of an elliptical tube, which is arranged around axial tube 7*a*, and clamps axial tube 7*a* of toothed wheel 7 to lock said wheel in a rest mode as shown in FIG. 6*a*. In this rest mode, the two electrodes provided on piezoelectric actuator 21 are not powered by an electrical voltage by terminals V+ and V− of electrical wires 27 and 28. However, when an electric voltage is delivered by terminals V+ and V− to the two electrodes of the piezoelectric actuator, said actuator takes the form of a circular tube as shown in FIG. 6*b*. Thus, toothed wheel 7 is released and can rotate freely on each actuation of the electric motor.

With the embodiment shown in FIGS. 6*a* and 6*b*, this does not require synchronisation between the toothed wheel and a bolt provided for locking the wheel. Said toothed wheel can be locked in any angular position. Moreover, this solution is not sensitive to the direction of a mechanical shock to the watch.

It is to be noted that for all the aforementioned embodiments, piezoelectric actuator 21 may also be electrically actuated to occupy a wheel locking position with or without the cooperation of a bolt 22. In such case, when piezoelectric actuator 21 is no longer electrically actuated in a rest mode, whether or not it is combined with a bolt 22, it releases the wheel, which can be driven in rotation on each actuation of the electric motor. Piezoelectric actuator 21 may also only be fixed to a support 23 at one end and free to move at the other end.

From the description that has just been given, several variant embodiments of the mechanism for driving one or more hands and/or a date disc, which is provided with a locking device, can be devised by those skilled in the art without departing from the scope of the invention defined by the claims. It is possible to envisage directly applying the strip of the piezoelectric actuator against the teeth of a wheel of the set of gear wheels. Several piezoelectric actuators may also be used to ensure the locking of one or more wheels between two actuations of the electric motor to move the time indicator hands forwards or backwards. The mechanism may also drive more than two hands while allowing the locking device to lock one part of the mechanism between two actuations of the electric motor.

What is claimed is:

1. A mechanism for driving one or more hands and/or at least one date disc of an electromechanical watch, the mechanism comprising, mounted on a plate or a frame of the mechanism:

an electric motor, a set of gear wheels connected to the electric motor to move the hand or hands and/or the date disc forward or backward on each actuation of the electric motor, and a locking device for locking at least one wheel of the set of gear wheels, said locking device comprising a stud fixed to the plate or the frame of the mechanism of the electromechanical watch, wherein the locking device includes a piezoelectric actuator or an electro-active polymer element or a shape memory element arranged for locking via a bolt at least one of the wheels of the set of gear wheels between each actuation of the electric motor, while allowing the set of gear wheels connected to said electric motor to move the hands and/or the date disc forward or backward on each actuation of the electric motor, and wherein the bolt is guided in a through aperture of the stud of the locking device fixed to the plate or the frame of the mechanism of the electromechanical watch.

2. The drive mechanism according to claim 1, wherein the piezoelectric actuator or electroactive polymer element or shape memory element is configured to lock one of the wheels of the set of gear wheels directly or via the bolt when the actuator is in a rest position without being electrically actuated, and wherein the actuator releases the wheel of the set of gear wheels, when the actuator is electrically actuated at the moment of each actuation of the electric motor in order to move the hand or hands and/or the date disc forward or backward.

3. The drive mechanism according to claim 1, wherein the piezoelectric actuator or the electroactive polymer element or the shape memory alloy element is a strip of rectangular shape, fixed at one end to a support of a plate or a frame of the electromechanical watch, and wherein at least one intermediate portion of the piezoelectric actuator or the electroactive polymer element or the shape memory alloy element is arranged to lock via the bolt, one of the wheels of the set of gear wheels.

4. The drive mechanism according to claim 1, wherein the piezoelectric actuator or the electroactive polymer element or the shape memory alloy element is a strip of rectangular shape, a first end of which is fixed to a first support of a plate or of a frame of the electromechanical watch, and a second end of which is fixedly held or free to move in a second support of the plate or of the frame.

5. The drive mechanism according to claim 1, wherein the bolt is in the form of a cylindrical rod, a first end of which is arranged to be housed between two teeth of a toothed wheel of the set of gear wheels in a locking position while being pushed at a second end by the piezoelectric actuator or the electroactive polymer element or the shape memory alloy element.

6. The drive mechanism according to claim 1, wherein the bolt is in the form of a cylindrical rod, a first end of which is arranged to be housed in one hole among several holes made in a toothed wheel of the set of gear wheels in a locking position while being pushed at a second end by the piezoelectric actuator or the electro-active polymer element or the shape memory alloy element.

7. The drive mechanism according to claim 6, wherein the number of holes is equal to the number of teeth of the toothed wheel of the set of gear wheels, and wherein the holes are regularly spaced and arranged on a concentric circle of the wheel.

8. A mechanism for driving one or more hands and/or at least one date disc of an electromechanical watch, the mechanism comprising:

an electric motor, a set of gear wheels connected to the electric motor to move the hand or hands and/or the date disc forward or backward on each actuation of the electric motor, and a locking device for locking at least one wheel of the set of gear wheels, wherein the locking device includes a piezoelectric actuator or an electroactive polymer element or a shape memory alloy element arranged for directly locking at least one of the wheels of the set of gear wheels with one portion of the piezoelectric actuator or the electro-active polymer element or the shape memory element, bearing on a surface of the wheel or against the wheel arbour, between each actuation of the electric motor, while allowing the set of gear wheels connected to said electric motor to move the hand or hands and/or the date disc forward or backward on each actuation of the electric motor.

9. The drive mechanism according to claim 8, wherein the piezoelectric actuator in the form of a rectangular strip includes a through aperture in an intermediate portion, which is traversed by an arbour of the toothed wheel, the intermediate portion being intended to bear, in the locking position, on the lower surface of the toothed wheel.

10. The drive mechanism according to claim 8, wherein the piezoelectric actuator or the electroactive polymer element, or the shape memory alloy element, in the form of a rectangular strip, is arranged to directly lock one toothed wheel of the set of gear wheels with one portion bearing on an arbour of the toothed wheel.

11. The drive mechanism according to claim 8, wherein the piezoelectric actuator or the electroactive polymer element or the shape memory alloy element takes the shape of a tube to be arranged on an arbour or axial tube of a toothed wheel of the set of gear wheels, wherein the piezoelectric actuator or the electroactive polymer element or shape memory alloy element takes the shape of an elliptical tube to hold the arbour of the toothed wheel clamped in a locking position, and wherein the piezoelectric actuator or the electroactive polymer element or shape memory alloy element takes the shape of a circular tube to release the toothed wheel and to allow the hands to move forwards or backwards.

12. The drive mechanism according to claim 11, wherein the piezoelectric actuator or the electroactive polymer element or the shape memory alloy element takes the shape of an elliptical tube in a rest mode with no electrical actuation and the shape of a circular tube when the piezoelectric actuator or the electro-active polymer element or the shape memory alloy element is actuated by an electrical signal.

13. The drive mechanism according to claim 8, wherein the piezoelectric actuator or electro-active polymer element or shape memory element is configured to lock one of the wheels of the set of gear wheels directly or via the bolt when the actuator is in a rest position without being electrically actuated and wherein the actuator releases the wheel of the set of gear wheels, when the actuator is electrically actuated at the moment of each actuation of the electric motor in order to move the hand or hands and/or the date disc forward or backward.

* * * * *